US012698617B2

(12) United States Patent
Kanazawa et al.

(10) Patent No.: US 12,698,617 B2
(45) Date of Patent: Aug. 4, 2026

(54) WORK MANAGEMENT SYSTEM AND WORK MACHINE

(71) Applicant: HITACHI CONSTRUCTION MACHINERY CO., LTD., Tokyo (JP)

(72) Inventors: Akira Kanazawa, Tokyo (JP); Ryu Narikawa, Tokyo (JP); Shinjirou Yamamoto, Tsuchiura (JP); Takaaki Chiba, Tsuchiura (JP); Shinya Imura, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 430 days.

(21) Appl. No.: 18/277,231

(22) PCT Filed: Mar. 29, 2022

(86) PCT No.: PCT/JP2022/015240
§ 371 (c)(1),
(2) Date: Aug. 15, 2023

(87) PCT Pub. No.: WO2022/254922
PCT Pub. Date: Dec. 8, 2022

(65) Prior Publication Data

US 2024/0125096 A1 Apr. 18, 2024

(30) Foreign Application Priority Data

Jun. 4, 2021 (JP) ..... 2021-094328

(51) Int. Cl.
*E02F 9/24* (2006.01)
*E02F 9/20* (2006.01)

(52) U.S. Cl.
CPC ..... *E02F 9/24* (2013.01); *E02F 9/2033* (2013.01)

(58) Field of Classification Search
CPC . E02F 9/261; E02F 9/24; E02F 9/2033; E02F 9/265; E02F 9/262; E02F 9/2025;
(Continued)

(56) References Cited

U.S. PATENT DOCUMENTS 9,332,229 B2 * 5/2016 Ishimoto ..... G06V 20/58
2019/0241124 A1 * 8/2019 Izumikawa ..... G08B 21/24
(Continued)

FOREIGN PATENT DOCUMENTS

JP 2006-188353 A 7/2006
JP 2010-198519 A 9/2010
(Continued)

OTHER PUBLICATIONS

International Search Report of PCT/JP2022/015240 dated Jun. 14, 2022.
(Continued)

*Primary Examiner* — Frederick M Brushaber
(74) *Attorney, Agent, or Firm* — MATTINGLY & MALUR, PC

(57) ABSTRACT

An object of the present invention is to provide a work management system that enables efficient extraction of approach events that are likely to result in contact between a work machine and a worker. For this object, a management server assesses whether or not there is approach between a work machine and a worker, on the basis of positional information about the work machine measured by a work machine position measuring apparatus, and positional information about the worker measured by a worker position measuring apparatus, and, when assessing that there is approach, assesses an approached state of the approach from a state of the work machine measured by a work machine state measuring apparatus at the time of the assessment of the approach, on the basis of a preset approached state
(Continued)

definition, and records the state of the work machine measured at the time of the assessment of the approach, in association with the approached state, and outputs the state of the work machine to a display apparatus in association with the approached state.

4 Claims, 15 Drawing Sheets

(58) Field of Classification Search
CPC .. E02F 9/26; H04N 7/183; H04N 7/18; B60Y 2200/412; B60Y 2200/415
See application file for complete search history.

(56) References Cited

U.S. PATENT DOCUMENTS

2020/0226849 A1 7/2020 Mizuochi et al.
2021/0158674 A1 5/2021 Cherney et al.
2021/0340723 A1* 11/2021 Velde ..... E02F 9/24
2022/0307232 A1* 9/2022 Kanazawa ..... E02F 9/261
2022/0333346 A1* 10/2022 Mizuochi ..... H04W 4/029
2022/0389686 A1* 12/2022 Holter ..... G05D 1/81
2023/0041612 A1* 2/2023 Nakao ..... G06V 40/103

FOREIGN PATENT DOCUMENTS

JP 2018-116323 A 7/2018
JP 2019-169778 A 10/2019
JP 2021-022170 A 2/2021
JP 2021-050587 A 4/2021
WO 2018/084161 A1 5/2018

OTHER PUBLICATIONS

International Preliminary Report on Patentability received in corresponding International Application No. PCT/JP2022/015240 dated Dec. 14, 2023.

* cited by examiner

FIG. 5

10c

| NO. | APPROACHED STATE | MOVABLE STATE | ACTION STATE | DISTANCE STATE | BLIND SPOT STATE |
|---|---|---|---|---|---|
| 1 | THERE IS APPROACH WHILE MACHINE IS UNMOVABLE | UNMOVABLE | STOPPED | ANY | ANY |
| 2 | THERE IS APPROACH WHILE MACHINE IS MOVABLE | MOVABLE | STOPPED | NOT CLOSE RANGE | NON-BLIND SPOT |
| 3 | THERE IS APPROACH FROM BLIND SPOT WHILE MACHINE IS MOVABLE | MOVABLE | STOPPED | NOT CLOSE RANGE | BLIND SPOT |
| 4 | THERE IS APPROACH TO CLOSE RANGE WHILE MACHINE IS MOVABLE | MOVABLE | STOPPED | CLOSE RANGE | ANY |
| 5 | THERE IS APPROACH WHILE MACHINE IS IN ACTION | MOVABLE | IN ACTION | NOT CLOSE RANGE | NON-BLIND SPOT |
| 6 | THERE IS APPROACH FROM BLIND SPOT WHILE MACHINE IS IN ACTION | MOVABLE | IN ACTION | NOT CLOSE RANGE | BLIND SPOT |
| 7 | THERE IS APPROACH TO CLOSE RANGE WHILE MACHINE IS IN ACTION | MOVABLE | IN ACTION | CLOSE RANGE | ANY |

10c

FIG. 9

| NO. | APPROACHED STATE | MOVABLE STATE | TRAVELLING STATE | DISTANCE STATE | BLIND SPOT STATE | WORKER-SIDE SAFETY APPARATUS | MACHINE-SIDE SAFETY APPARATUS |
|---|---|---|---|---|---|---|---|
| 1 | THERE IS APPROACH WHILE MACHINE IS UNMOVABLE | UNMOVABLE | STOPPED | ANY | ANY | ACTUATED | ACTUATED |
| 2 | THERE IS APPROACH WHILE MACHINE IS MOVABLE | MOVABLE | STOPPED | NOT CLOSE RANGE | NON-BLIND SPOT | ACTUATED | ACTUATED |
| 3 | THERE IS APPROACH FROM BLIND SPOT WHILE MACHINE IS MOVABLE | MOVABLE | STOPPED | NOT CLOSE RANGE | BLIND SPOT | ACTUATED | ACTUATED |
| 4 | THERE IS APPROACH TO CLOSE RANGE WHILE MACHINE IS MOVABLE | MOVABLE | STOPPED | CLOSE RANGE | ANY | ACTUATED | ACTUATED |
| 5 | WORKER-SIDE AVOIDING APPARATUS IS NOT ACTUATED WHILE THERE IS APPROACH TO CLOSE RANGE WHILE MACHINE IS MOVABLE | MOVABLE | STOPPED | CLOSE RANGE | ANY | NOT ACTUATED | ACTUATED |
| 6 | MACHINE-SIDE AVOIDING APPARATUS IS NOT ACTUATED WHILE THERE IS APPROACH TO CLOSE RANGE WHILE MACHINE IS MOVABLE | MOVABLE | STOPPED | CLOSE RANGE | ANY | ACTUATED | NOT ACTUATED |
| 7 | BOTH WORKER-SIDE AVOIDING APPARATUS AND MACHINE-SIDE AVOIDING APPARATUS ARE NOT ACTUATED WHILE THERE IS APPROACH TO CLOSE RANGE WHILE MACHINE IS MOVABLE | MOVABLE | STOPPED | CLOSE RANGE | ANY | NOT ACTUATED | NOT ACTUATED |
| 8 | THERE IS APPROACH WHILE MACHINE IS IN ACTION | MOVABLE | TRAVELLING | NOT CLOSE RANGE | NON-BLIND SPOT | ACTUATED | ACTUATED |
| 9 | THERE IS APPROACH FROM BLIND SPOT WHILE MACHINE IS IN ACTION | MOVABLE | TRAVELLING | NOT CLOSE RANGE | BLIND SPOT | ACTUATED | ACTUATED |
| 10 | THERE IS APPROACH TO CLOSE RANGE WHILE MACHINE IS IN ACTION | MOVABLE | TRAVELLING | CLOSE RANGE | ANY | ACTUATED | ACTUATED |
| 11 | WORKER-SIDE AVOIDING APPARATUS IS NOT ACTUATED WHILE THERE IS APPROACH TO CLOSE RANGE WHILE MACHINE IS IN ACTION | MOVABLE | TRAVELLING | CLOSE RANGE | ANY | NOT ACTUATED | ACTUATED |
| 12 | MACHINE-SIDE AVOIDING APPARATUS IS NOT ACTUATED WHILE THERE IS APPROACH TO CLOSE RANGE WHILE MACHINE IS IN ACTION | MOVABLE | TRAVELLING | CLOSE RANGE | ANY | ACTUATED | NOT ACTUATED |
| 13 | BOTH WORKER-SIDE AVOIDING APPARATUS AND MACHINE-SIDE AVOIDING APPARATUS ARE NOT ACTUATED WHILE THERE IS APPROACH TO CLOSE RANGE WHILE MACHINE IS IN ACTION | MOVABLE | TRAVELLING | CLOSE RANGE | ANY | NOT ACTUATED | NOT ACTUATED |

FIG. 15

TA

| NO. | APPROACHED STATE | MEASURE |
|---|---|---|
| 1 | THERE IS APPROACH WHILE MACHINE IS UNMOVABLE | NOT NEEDED TO BE HANDLED |
| 2 | THERE IS APPROACH WHILE MACHINE IS MOVABLE | NOT NEEDED TO BE HANDLED |
| 3 | THERE IS APPROACH FROM BLIND SPOT WHILE MACHINE IS MOVABLE | NOT NEEDED TO BE HANDLED |
| 4 | THERE IS APPROACH TO CLOSE RANGE WHILE MACHINE IS MOVABLE | ALERT |
| 5 | THERE IS APPROACH WHILE MACHINE IS IN ACTION | MACHINE DECELERATION |
| 6 | THERE IS APPROACH FROM BLIND SPOT WHILE MACHINE IS IN ACTION | MACHINE STOP |
| 7 | THERE IS APPROACH TO CLOSE RANGE WHILE MACHINE IS IN ACTION | MACHINE STOP |

WORK MANAGEMENT SYSTEM AND WORK MACHINE

TECHNICAL FIELD

The present invention relates to a work management system that manages the safety of workers performing work near work machines.

BACKGROUND ART

There is a fear that a nearby worker and a work machine contact each other at a construction work site, and there is a need for a function for preventing contact between a nearby worker and a work machine. Particularly, for the purpose of preventing contact between a nearby worker and a work machine before it happens, there are systems that have started being put into practical use, in which systems positional information obtained from sensors attached to a nearby worker and a work machine is aggregated at a management server, and monitoring, warning, and displaying are performed about inappropriate events such as approach of a work machine toward a nearby worker or entry of a nearby worker into an entry-prohibited area. Introduction of such systems has enabled managers of construction sites to simply and conveniently grasp in real time inappropriate events that have occurred at the sites.

As an example of the prior art in which positional information about nearby workers and work machines is aggregated at a management server, and inappropriate events are monitored and are presented to a manager, technologies like the one in Patent Document 1 have been disclosed. Patent Document 1 discloses a managing apparatus that detects entry of an obstacle into a predetermined area near a machine, and, on the basis of the history of detection results and related information at the time of entry, generates a table on which the relation between the degree of entry of the obstacle into the predetermined area and entry-related information can be checked.

PRIOR ART DOCUMENT

Patent Document

Patent Document 1: WO 2018/084161

SUMMARY OF THE INVENTION

Problem to be Solved by the Invention

Contact between a nearby worker and a work machine occurs due to a human error of the nearby worker or an operator who operates the work machine. Conceivable situations where the operator side of a work machine becomes a cause of a human error include a situation where an operator of a work machine touches an operation lever unintendedly while the operator fails to lock the machine body when machine actions are inactivated, and a situation where an operator of a work machine operates the work machine carelessly near a nearby worker. On the other hand, conceivable situations where the nearby worker side becomes a cause of a human error include a situation where a nearby worker approaches a work machine from a direction which is difficult for an operator to see, a situation where a nearby worker fails to give the cue before approach, and the like. Accordingly, in order to more accurately evaluate the likelihood of contact events, it is necessary to consider the states of both a nearby worker and a work machine at the time of occurrence of an approach event.

In a system like the one described in Patent Document 1, although information about the position and time at which approach is detected, and about the operational status of a work machine is provided to a manager, it does not take into consideration under what situation each of a nearby worker and an operator of the work machine have been. Accordingly, it is difficult for the manager to correctly determine the likelihood of contact in an approach event that has occurred, and it is difficult to select approach information that should be used for risk assessment for the future or safety education of site workers from among an enormous amount of provided approach information. Since it is predicted that approach between nearby workers and work machines occurs frequently, it is desirable if the manager can efficiently extract only approach events that should be avoided in the future.

The present invention has been made in view of the problem described above, and an object of the present invention is to provide a work management system that enables efficient extraction of approach events that are likely to result in contact between a work machine and a worker.

Means for Solving the Problem

In order to achieve the object described above, in the present invention, a work management system including a management server, and a display apparatus that displays information outputted from the management server includes: a work machine position measuring apparatus that measures positional information about a work machine; a work machine state measuring apparatus that measures a state of the work machine; and a worker position measuring apparatus that measures positional information about a worker who performs work near the work machine. Further, the management server: assesses approach between the work machine and the worker on the basis of the positional information about the work machine measured by the work machine position measuring apparatus, and the positional information about the worker measured by the worker position measuring apparatus; and, when assessing that there is approach, assesses an approached state of the approach from the state of the work machine measured by the work machine state measuring apparatus at the time of the assessment of the approach, on the basis of a preset approached state definition, records the states of the work machine measured at the time of the assessment of the approach, in association with the approached state, and outputs the state to the display apparatus in association with the approached state.

According to the thus-configured present invention, a result of the assessment regarding the approach between the work machine and the worker is displayed in association with the approached state that takes into consideration the state of the work machine at the time of the approach assessment. Accordingly, it becomes possible to efficiently extract approach events that are likely to result in contact between the work machine and the worker. As a result, the effectiveness and efficiency of risk assessment and safety education by the manager are enhanced significantly.

Advantages of Invention

The work management system according to the present invention enables efficient extraction of approach events that are likely to result in contact between a work machine and a worker.

BRIEF DESCRIPTION OF THE DRAWINGS

FIG. 5 is a diagram depicting an example of an approached state definition in the first embodiment.

FIG. 9 is a diagram depicting an example of the approached state definition in the second embodiment of the present invention.

FIG. 15 is a diagram depicting an example of a definition of measures to be taken regarding the approached state definition in the fifth embodiment of the present invention.

MODES FOR CARRYING OUT THE INVENTION

Figure 1:
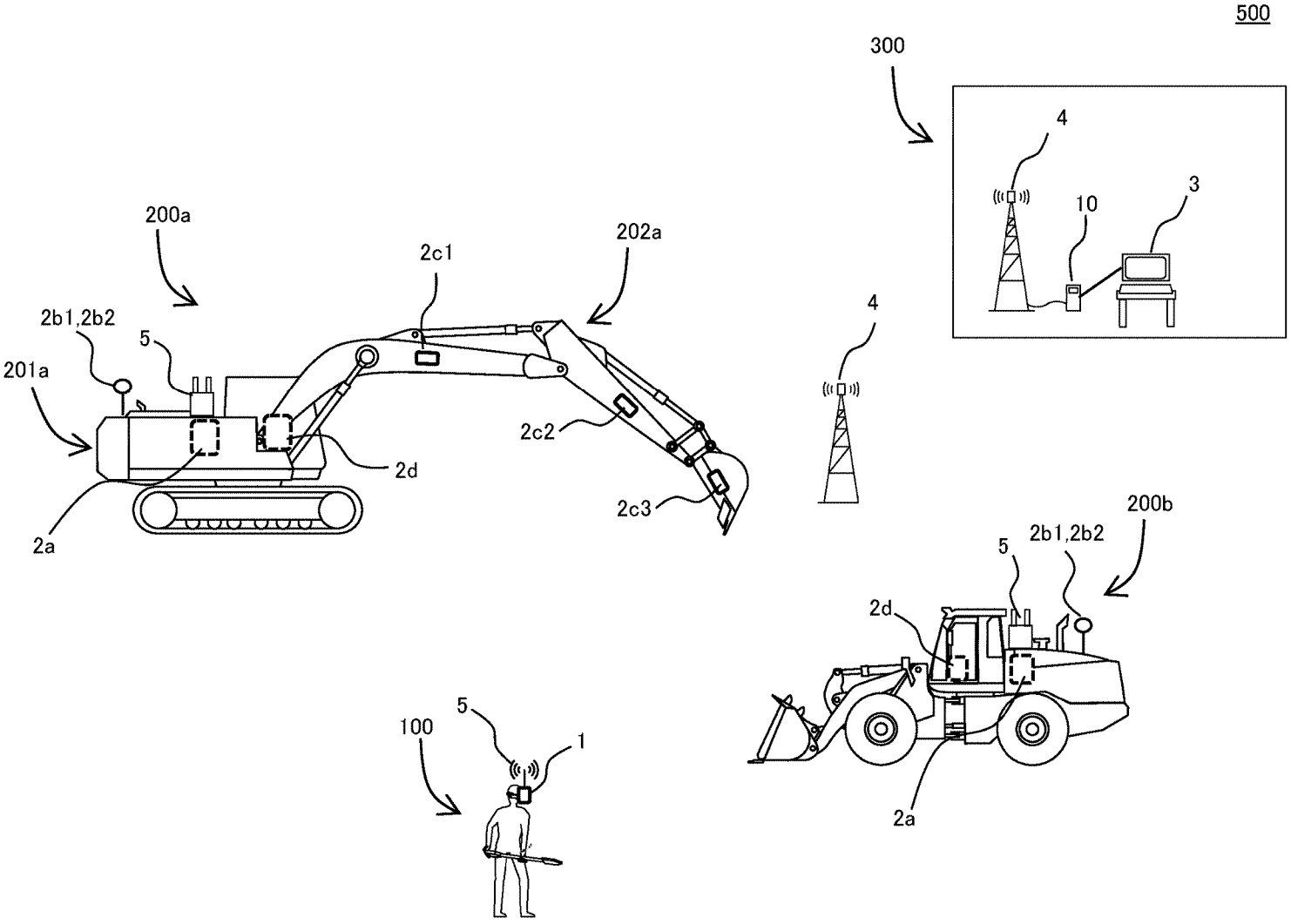
FIG. 1 is a figure depicting an overview of a work management system according to a first embodiment of the present invention.

Hereinbelow, embodiments of the present invention are explained by using the figures or the like. The following explanation depicts specific examples of the content of the present invention. The present invention is not limited to the explanation. Those skilled in the art can make various changes and corrections within the scope of the technical idea disclosed in the present specification. In addition, ones in all the figures for explaining the present invention that have identical functions are given identical reference characters, and repetitive explanations thereof are omitted in some cases.

First Embodiment

FIG. 1 is a figure depicting an overview of a work management system according to a first embodiment of the present invention. A work management system 500 includes: a worker measuring apparatus 1 attached to a worker 100; a machine measuring apparatus 2 attached to a work machine 200; a display apparatus 3; a communication facility 4; a management server 10; and the like. The worker 100 is a person who performs work in a construction site, and performs work assistance for a work machine 200, peripheral work not directly related to a work machine 200, and the like. The worker 100 has the worker measuring apparatus 1 and a communication terminal 5, and it is assumed that these worker measuring apparatus 1 and communication terminal 5 are attached to a helmet, working clothes, or the like that the worker 100 puts on. It is assumed in the present embodiment that the worker measuring apparatus 1 includes: a sensor 1*b* for measuring positional information about the worker 100; and a data processing apparatus 1*a* for processing the information measured by the sensor 1*b* and communicating with the outside. The sensor 1*b* is included in a worker position measuring apparatus that measures the positional information about the worker 100. It is assumed that a GNSS (Global Navigation Satellite System), a Beacon, or the like is used for the sensor 1*b*.

The work machines 200 include any type of machine that performs work such as a construction machine or a haulage vehicle that is active at a construction site. A hydraulic excavator 200*a* and a wheel loader 200*b* are illustrated as the work machines 200 in FIG. 1. The hydraulic excavator 200*a* includes the machine measuring apparatus 2 and the communication terminal 5. It is assumed in the present embodiment that the machine measuring apparatus 2 includes: a sensor 2*b* that measures the position and orientation of an upper swing structure 201*a* of the hydraulic excavator 200*a*; a sensor 2*c* that measures the posture of a front device 202*a* of the hydraulic excavator 200*a*; a sensor 2*d* that acquires the movable state of the hydraulic excavator 200*a*; and a data processing apparatus 2*a* for processing the information measured by the sensors 2*b*, 2*c*, and 2*d* and communicating with the outside. At least two GNSS antennas are used for the sensor 2*b*, and the sensor 2*b* is configured such that both the position and orientation can be computed. In addition, IMUs (Inertial Measurement Units), stroke sensors, and the like are used for the sensor 2*c*, and are included in links configuring the front device 202*a*. It is assumed that the sensor 2*d* is a lock lever sensor that electrically senses the ON/OFF state of a lock lever that locks machine body actions, but a sensor that senses the ON/OFF state of the engine or the engine revolution speed may be used as the sensor 2*d*.

The wheel loader 200*b* includes the machine measuring apparatus 2 and the communication terminal 5. It is assumed in the present embodiment that the machine measuring apparatus 2 includes: the sensor 2*b* that measures the position and orientation of the wheel loader 200*b*; the sensor 2*d* that acquires the movable state of the wheel loader 200*b*; and the data processing apparatus 2*a* for processing the information measured by the sensors 2*b* and 2*d* and communicating with the outside. At least two GNSS antennas are used for the sensor 2*b*, and the sensor 2*b* is configured such that both the position and orientation can be computed. It is assumed that the sensor 2*d* is a parking brake sensor that electrically senses the ON/OFF state of a parking brake that locks machine body actions, but a sensor that senses the ON/OFF state of the engine or the engine revolution speed may be used as the sensor 2*d*.

The communication facility 4 is a facility that enables connection, to the same network, of all types of controller and sensor in the construction site including the communication terminals 5 included in the worker 100 and the work machine 200, and includes an access point of a wireless LAN (Local Area Network) or the like. The management server 10 is a computer connected to the communication network of the communication facility 4. It is assumed in the present embodiment that the management server 10 is included in an office 300, and is connected with the display apparatus 3 provided to a personal computer or the like for accepting input from users or for display-outputting analysis results. Note that the management server 10 may be prepared as a virtual machine on a cloud computing system, and configured such that it can communicate with the cloud computing system through the network provided by the communication facility 4. It is assumed that the communication terminals 5 included in the worker 100 and the work machine 200 can be connected to the communication network provided by the communication facility 4, and can transmit measurement information to the management server 10 connected to the same network.

Figure 2:
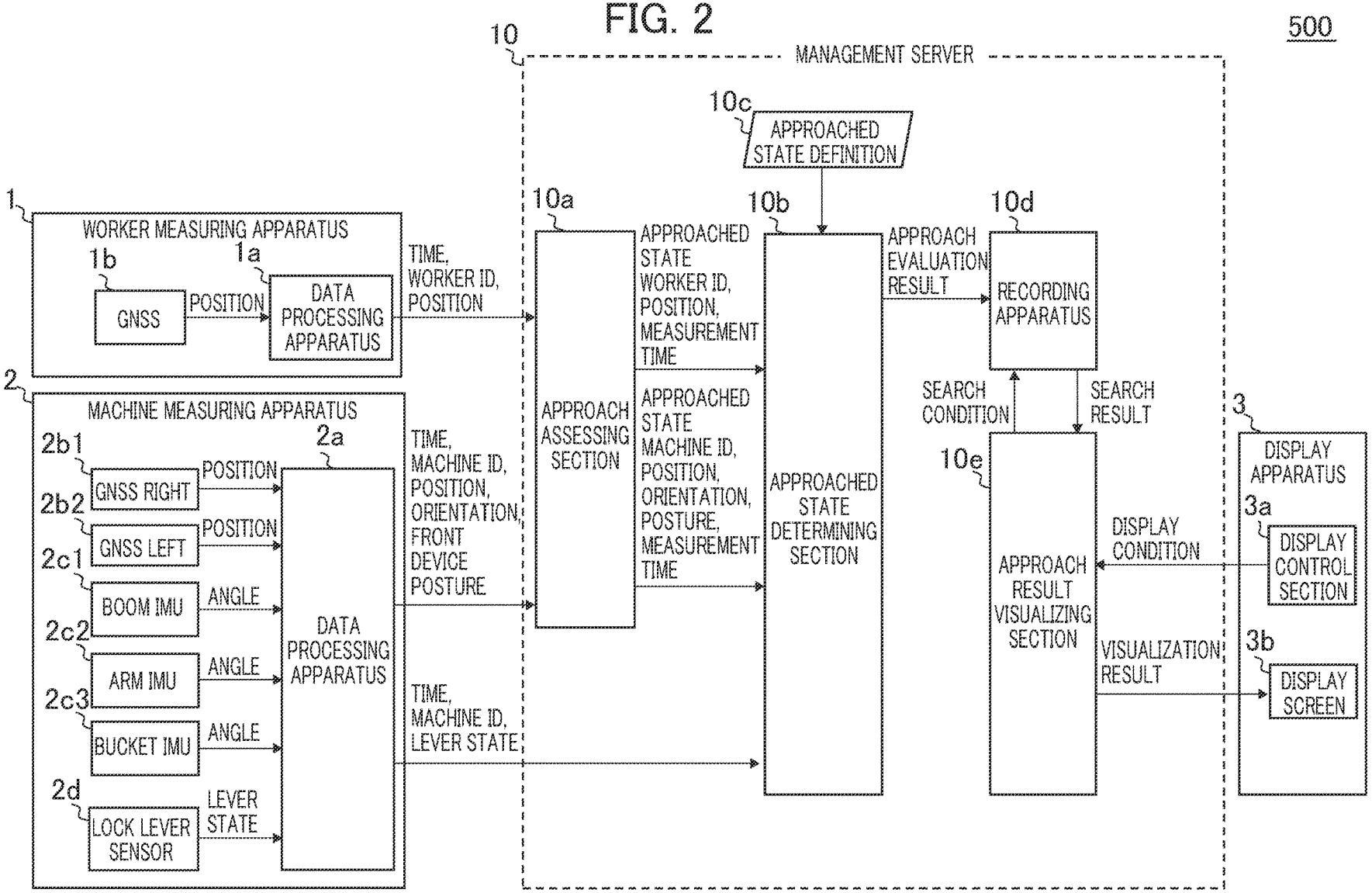
FIG. 2 is a functional block diagram depicting process functions of the work management system according to the first embodiment of the present invention.

FIG. 2 is a functional block diagram depicting process functions of the work management system 500 according to the present embodiment. Functional blocks of the work management system 500 include the worker measuring apparatus 1, the machine measuring apparatus 2, the display apparatus 3, and the management server 10. Note that it is assumed in this description that the machine measuring apparatus 2 is mounted on the hydraulic excavator 200*a*.

The worker measuring apparatus 1 has the data processing apparatus 1*a*, and the GNSS 1*b* that measures the positional information about the worker 100. The GNSS 1*b* is included in the worker position measuring apparatus. The data processing apparatus 1*a* transmits, to the management server 10 via the communication terminal 5, the individual ID (Identification) and position of the worker 100 carrying the worker measuring apparatus 1, and a time at which measurement has been performed. The machine measuring apparatus 2 includes: the data processing apparatus 2*a*; a GNSS right 2*b*1 and a GNSS left 2*b*2 which are sensors for measuring the position and posture of the upper swing structure 201*a* of the hydraulic excavator 200*a*; a boom IMU 2*c*1, an arm IMU 2*c*2, and a bucket IMU 2*c*3 which are sensors for measuring the posture of the front device 202*a* of the hydraulic excavator 200*a*; and the lock lever sensor 2*d*. The GNSS right 2*b*1 and the GNSS left 2*b*2 are included in a work machine position measuring apparatus that measures the position of the work machine 200. The boom IMU 2*c*1, the arm IMU 2*c*2, the bucket IMU 2*c*3, and the lock lever sensor 2*d* are included in a state measuring apparatus that measures the state of the work machine 200. The data processing apparatus 2*a* transmits, to the management server 10 via the communication terminal 5 included in the work machine 200, information about the individual ID, position, orientation, front device posture, and lever state of the machine in which the data processing apparatus 2*a* is included, and times at which those pieces of information have been measured.

The management server 10 includes an approach assessing section 10*a*, an approached state determining section 10*b*, an approached state definition 10*c*, a recording apparatus 10*d*, and an approach result visualizing section 10*e*.

Figure 3:
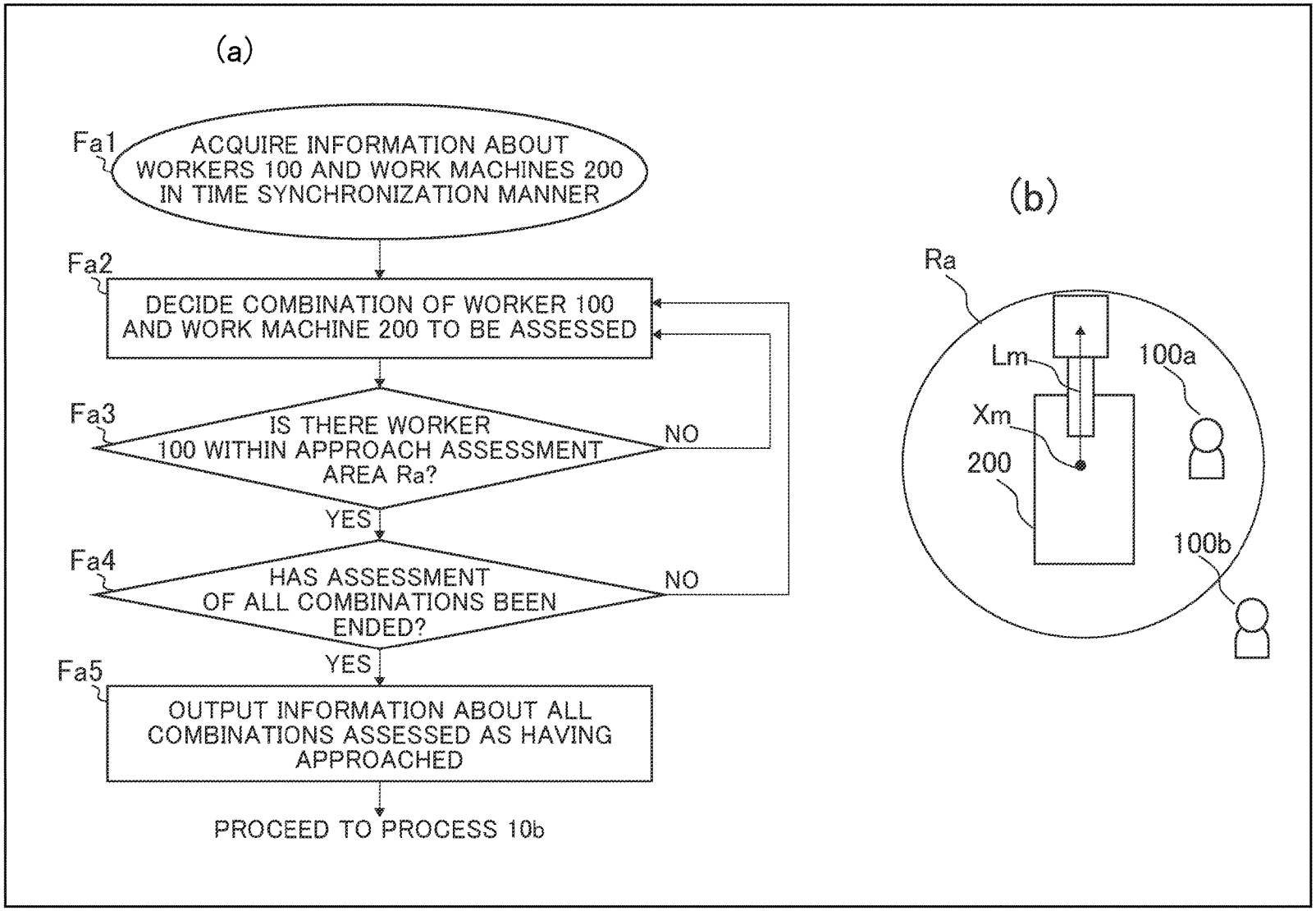
FIG. 3 is a figure depicting a processing procedure performed by an approach assessing section in the first embodiment of the present invention.

FIG. 3 is a figure depicting a processing procedure performed by the approach assessing section 10*a* in the present embodiment. An approach assessment process is performed along the procedure depicted in FIG. 3A. Here, an explanation is given by taking, as an example of the work machines 200, the hydraulic excavator 200*a* which makes the process relatively complicated. First, in a process Fa1, measurement information acquired from the worker measuring apparatuses 1 and the machine measuring apparatuses 2 is acquired in a time synchronization manner. Time synchronization means a process of grouping a plurality of pieces of measurement information such that measurement times outputted by the measuring apparatuses 1 and 2 are within a certain time range. Next, in a process Fa2, one combination of one selected worker 100 and one selected work machine 200 is decided from among a plurality of combinations of the workers 100 and the work machines 200 obtained.

Next, in a process Fa3, it is determined whether there is the worker 100 within a preset approach assessment area Ra. FIG. 3B represents a definition of the approach assessment area Ra in the present embodiment. The approach assessment area Ra is defined as a circle centered on a position Xm of the work machine 200. It is assumed that the radius of the circle increases and decreases depending on a front device length Lm computed from the posture of the front device 202*a* measured by the machine measuring apparatus 2, and it is assumed in the present embodiment that a length obtained by adding a certain margin to the front device length Lm is defined as the radius of the approach assessment area Ra. A state where a worker 100 is present inside the approach assessment area Ra is defined as an approached state, and a state where a worker 100 is present outside the approach assessment area Ra is defined as a non-approached state. For example, a worker 100*a* depicted in FIG. 3B is treated as being in an approached state, and a worker 100*b* depicted in FIG. 3B is treated as being in a non-approached state. Note that the method of expressing the approach assessment area Ra is not limited to the method described above, but an ellipse, a rectangle, or the like may be adopted.

Returning to FIG. 3A, if it is determined in the process Fa3 that the worker 100 is in an approached state, the procedure proceeds to a process Fa4. In contrast, if it is determined that the worker 100 is in a non-approached state, the procedure returns to the process Fa2, and an unprocessed combination of a worker 100 and a work machine 200 is decided. Next, in the process Fa4, it is determined whether the approach assessment process has been performed on all combinations. Where there is a remaining combination on which the approach assessment process has not been performed yet, the procedure returns to the process Fa2, and an unprocessed combination of a worker 100 and a work machine 200 is decided. In contrast, where the approach assessment process has been completed for all the combinations, the procedure proceeds to a process Fay, information about all combinations that have been assessed as being in approached states is outputted to the approached state determining section 10*b*, and a process to be performed by the approached state determining section 10*b* is started.

Returning to FIG. 2, the approached state determining section 10*b* determines the approached state of the worker 100 and the work machine 200 that has been assessed as being in the approached state, on the basis of the predefined approached state definition 10*c* stored in the management server 10.

Figure 4:
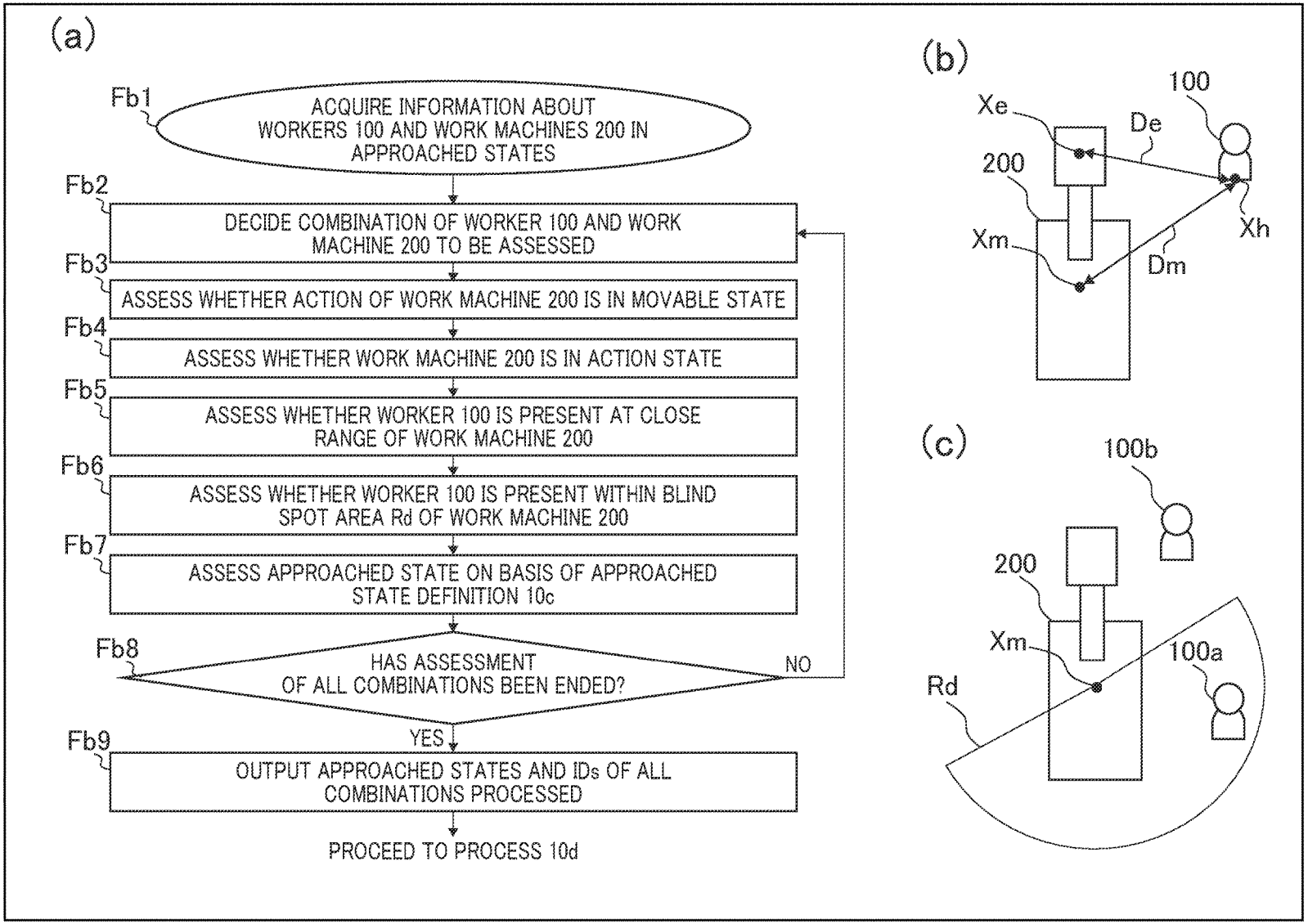
FIG. 4 is a figure depicting a processing procedure performed by an approached state determining section in the first embodiment of the present invention.

FIG. 4 is a figure depicting a processing procedure performed by the approached state determining section 10*b* in the present embodiment. The approached state determination process is performed along the procedure depicted in FIG. 4A. Here, an explanation is given by taking, as an example of the work machine 200, the hydraulic excavator 200*a* which makes the process relatively complicated. First, in a process Fb1, information about the workers 100 and the work machines 200 that have been determined as being in the approached states by the approach assessing section 10*a* is acquired. It is assumed that, at this time, the activation states of the corresponding work machines 200 also are acquired in a time synchronization manner from the machine measuring apparatuses 2. Next, in a process Fb2, one combination of one worker 100 and one work machine 200 is selected from among the plurality of combinations of the workers 100 and the work machines 200 obtained. Next, in a process Fb3, it is determined whether or not an action of the work machine 200 which has become the assessment target is in a movable state, on the basis of a lever state obtained from the machine measuring apparatus 2. A movable state is represented by the value of a binary flag representing whether or not the lever operation or autonomous actions of the work machine 200 is/are limited.

Next, in a process Fb4, it is determined whether the work machine 200 is in an action state. The assessment as to whether the work machine 200 is in an action state is implemented on the basis of: a velocity Vm determined by obtaining numerical differences of the position Xm of the work machine 200 over time; and a velocity Ve determined by obtaining numerical differences of a tip position Xe of the front device 202*a* computed on the basis of postural information about the front device 202*a* over time. Thresholds Vth1 and Vth2 preset for the velocities Vm and Ve are referred to, and a state where at least either Vth1>|Vm| or Vth2>|Ve| is satisfied is defined as an action state, and a state where none of Vth1>|Vm| and Vth2>|Ve| is satisfied is defined as a stopped state. Note that determination may be performed for each of the conditions about the magnitudes of the machine velocity Vm and the front device tip position velocity Ve, and the travelling state (travelling velocity) of the work machine 200, and the action state (each pivoting velocity of the plurality of joints that the front device 202*a* has) of the front device 202*a* may be defined separately.

Next, in a process Fb5, it is determined whether the worker 100 is present at a close range of the work machine 200. The assessment as to whether the worker 100 is at a close range is executed on the basis of the distances between the position Xm of the work machine 200 and the tip position Xe of the front device 202*a*, and a position Xh of the worker 100. As depicted in FIG. 4B, the distance between the machine position Xm and the worker position Xh is defined as Dm, and the distance between the front device tip position Xe and the worker position Xh is defined as De. Distance thresholds Dth1 and Dth2 are defined in advance for the distances Dm and De, respectively. A state where either Dth1>Dm or Dth2>De is satisfied is defined as a short distance state, a state where none of Dth1>Dm and Dth2>De is satisfied is defined as a non-short distance state.

Next, in a process Fb6, it is determined whether the worker 100 is present within a blind spot area Rd of the work machine 200. The blind spot area Rd is defined as a sector which is a part of a circle centered on the position Xm of the work machine 200. It is assumed that, similarly to the approach assessment area Ra, the radius of the sector increases and decreases depending on the front device length Lm computed from the posture of the front device 202*a* measured by the machine measuring apparatus 2. It is assumed that the range of the sector is preset to an angle range that is predicted to be difficult for an operator at the operator's seat of the work machine 200 to see. In the example depicted in FIG. 4C, areas on the back of the work machine 200 and the right side of the work machine 200 that are difficult for the operator to see are defined as the blind spot area Rd. A state where a worker 100 is present inside the approach assessment area Rd is defined as a blind spot state, and a state where a worker 100 is present outside the approach assessment area Rd is defined as a non-blind spot state. For example, the worker 100*a* depicted in FIG. 4C is treated as being in a blind spot state, and the worker 100*b* depicted in FIG. 4C is treated as being in a non-blind spot state. Note that the method of expressing the approach assessment area Rd is not limited to the method described above, but an ellipse, a rectangle, or the like may be adopted.

Returning to FIG. 3A, in a process Fb7, a final approached state is determined on the basis of the approached state definition 10*c* defined in advance on the basis of the locking state determined in the process Fb3, the action state determined in the process Fb4, the distance state determined in the process Fb5, and the blind spot state determined in the process Fb6.

FIG. 5 is a diagram depicting an example of the approached state definition 10*c* in the present embodiment. It is assumed that an approached state is decided by a combination of four states which are a movable state, an action state, a distance state, and a blind spot state each of which is given as the value of a binary flag. In the present embodiment, seven states depicted in FIG. 5 are defined as approached states. Note that it is assumed that approached states are not limited to the content depicted in FIG. 5, but necessary states can be defined in advance according to the states of the worker 100 and the work machine 200 to be acquired.

Returning to FIG. 4A, after the approached state is decided in the process Fb7, it is assessed in a process Fb8 whether or not approached states of all the combinations have been decided. Where there are remaining combinations on which the approached state determination process has not been performed yet, the procedure returns to the process Fb2, and an unprocessed combination of a worker 100 and a work machine 200 is decided. In contrast, where the approached state determination process has been completed for all the combinations, the procedure proceeds to a process Fb9, and information about all the combinations whose approached states have been decided, and the IDs of the workers 100 and the work machines 200 that have been involved in approach in the respective approached states are outputted to and stored in the recording apparatus 10*d* such as a memory.

Returning to FIG. 2, the recording apparatus 10*d* records an approach evaluation result outputted by the approached state determining section 10*b*. It is assumed that the approach evaluation result is a result generated by putting together the information about times of occurrence of approach, approached state, and the ID, position, orientation, and posture of the respective involved worker 100 and work machine 200. In addition, the recording apparatus 10*d* receives input of search conditions for extracting data desired by the approach result visualizing section mentioned later. It is assumed that a time range, an approached state, the ID of the worker 100 or the work machine 200, and the like to be displayed can be selected as the search conditions. Relevant result is extracted from an approach evaluation result group recorded on the recording apparatus 10*d* in accordance with those search conditions, and the search result is outputted to the approach result visualizing section 10*e*.

The approach result visualizing section 10*e* generates search conditions for extracting necessary data in accordance with display conditions inputted from a display control section 3*a* included in the display apparatus 3, and outputs the search conditions to the recording apparatus 10*d*. In addition, the approach result visualizing section 10*e* visualizes the search results outputted from the recording apparatus 10*d* by a chart, a map, or the like in such a format that each occurrence of approach that has occurred and an approached state at that time can be grasped clearly, on the basis of the results. The visualized results are outputted to a display screen 3*b* such as a monitor included in the display apparatus 3.

Figure 6:
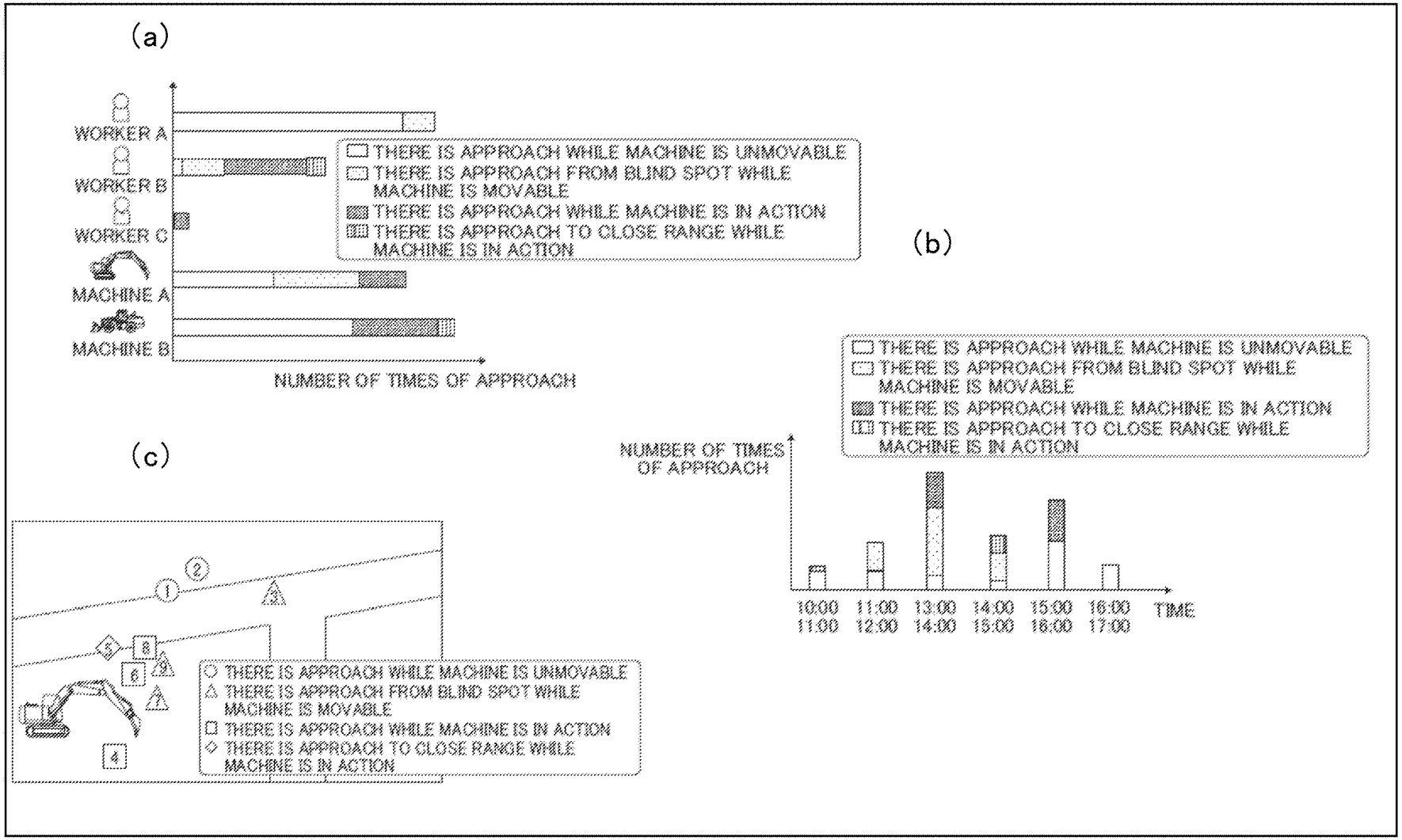
FIG. 6 is a diagram depicting examples of approach results outputted by an approach result visualizing section in the first embodiment.

FIG. 6 is a diagram depicting examples of an approach result outputted by the approach result visualizing section 10*e* in the present embodiment. FIG. 6A depicts an example of visualization of an approach result as a labelled bar chart having approached states as labels where the horizontal axis represents the number of times of approach, and the vertical axis represents the workers 100 and the work machines 200 involved in the approach. If an approach result is visualized in a format as in FIG. 6A, it is clearly expressed which workers 100 or work machines 200 have been involved in approach, and how inappropriate the approach has been. FIG. 6B depicts an example of visualization of an approach result as a labelled bar chart having approached states as labels where the horizontal axis represents times of occurrence, and the vertical axis represents the number of times of approach. If an approach result is visualized in a format as in FIG. 6B, it is clearly expressed when an inappropriate approach has occurred, and how inappropriate the approach has been. FIG. 6C depicts an example of visualization of an approach result by labelling each occurrence of approach, and plotting the approach occurrence position on a map. If an approach result is visualized in a format as in FIG. 6C, it is clearly expressed where a lot of inappropriate approach have occurred, and how inappropriate the approach has been. Note that the three examples depicted in FIG. 6 are examples of the visualization method, and it is also assumed that other display forms in which approached states are associated with respective occurrences of approach are used.

Figure 7:
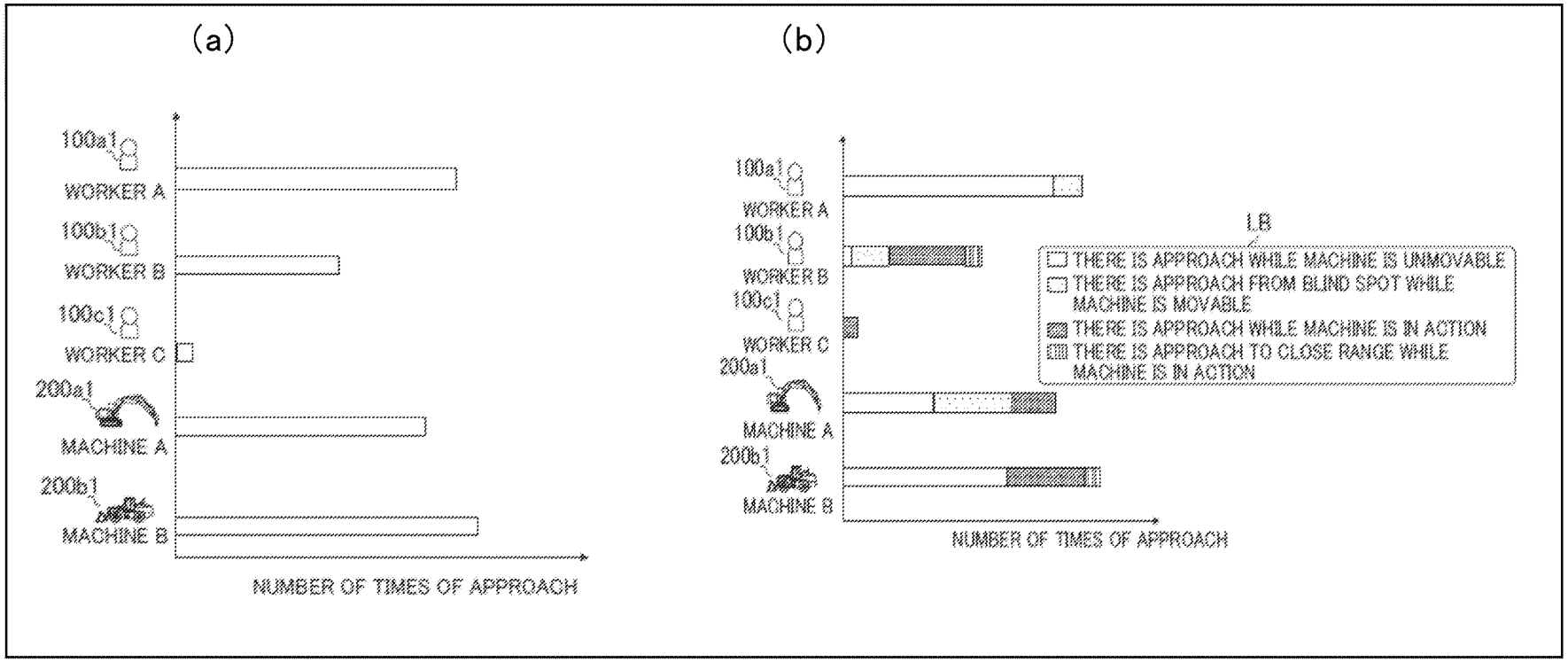
FIG. 7 is a figure depicting advantages of the present invention according to the first embodiment.

FIG. 7 is a figure depicting advantages of the present invention according to the present embodiment. FIG. 7A depicts a result in which the number of times of approach of the workers 100 and the number of times of approach of the work machines 200 involved in the approach are displayed without being associated with approached states. It can be seen in the display format in FIG. 7A that a worker A100*a*1 and a worker B100*b*1 whose numbers of times of approach are great can be the target of safety education. However, since it cannot be determined what type of approach each worker 100 has been involved in, it is difficult for the manager side to present the specific direction of behavior correction.

FIG. 7B depicts results in which the number of times of approach of the workers 100 and the number of times of approach of the work machines 200 involved in the approach are displayed in a labelled bar chart in association with details LB of approached states. The display format in FIG. 7B clearly expresses the details LB of the approached state of the approach that each worker has been involved in. Accordingly, since it can be known that approach of the worker A100*a*1 who tends to be determined as being likely to contact a work machine 200 in terms of the number of times of approach is, in most cases, approach that occurs while machines are unmovable, and is relatively unlikely to result in contact, the priority of the worker A100*a*1 as the target of safety education lowers relatively. On the other hand, approach of the worker B100*b*1 is, in most cases, approach that is likely to result in contact such as approach to a work machine 200 in a movable state, approach from a blind spot, or approach to a work machine 200 while it is in action. Accordingly, it can be determined that the priority of the worker B100*b*1 as the target of safety education is higher than that of the worker A100*a*1 whose number of times of approach is greater. Furthermore, by collating details LB of approached states with approach results of each of the worker 100 and the work machine 200, it becomes easier for the manager to present the specific direction of behavior correction. For example, since the worker B100*b*1 often approaches a work machine while it is in action, it can be determined that it is necessary to improve the awareness of the worker B100*b*1 such that she/he becomes careful of approach to a work machine while it is in action, particularly.

(Summary)

In the present embodiment, the work management system 500 including the management server 10, and the display apparatus 3 that displays information outputted from the management server 10 includes: the work machine position measuring apparatuses 2*b*1 and 2*b*2 that measure positional information about a work machine 200; the work machine state measuring apparatuses 2*c*1, 2*c*2, 2*c*3, and 2*d* that measure states of the work machine 200; and the worker position measuring apparatus 1*b* that measures positional information about a worker 100 who performs work near the work machine 200. In the work management system 500, the management server 10 assesses approach between the work machine 200 and the worker 100 on the basis of the positional information about the work machine 200 measured by the work machine position measuring apparatuses 2*b*1 and 2*b*2, and the positional information about the worker 100 measured by the worker position measuring apparatus 1*b*, and when it is assessed that there is approach, assesses an approached state of the approach from the states of the work machine 200 measured by the work machine state measuring apparatuses 2*c*1, 2*c*2, 2*c*3, and 2*d* at the time of the assessment of the approach on the basis of the preset approached state definition 10*c*, records the states of the work machine 200 measured at the time of the assessment of the approach in association with the approached state, and outputs the states to the display apparatus 3 in association with the approached state.

According to the thus-configured present embodiment, a result of assessment regarding the approach between the work machine 200 and the worker 100 is displayed in association with the approached state taking into consideration the states of the work machine 200 at the time of the approach assessment. Accordingly, it becomes possible to efficiently extract approach events that are likely to result in contact between the work machine 200 and the worker 100. As a result, the effectiveness and efficiency of risk assessment and safety education by the manager are enhanced significantly.

In addition, the work machine state measuring apparatus 2*d* in the present embodiment measures a movable state of the work machine 200. Thus, it becomes possible to assess the approached state taking into consideration the movable state of the work machine 200.

In addition, the work machine 200 in the present embodiment has the front device 202*a* having the plurality of joints, and the work machine state measuring apparatuses 2*c*1, 2*c*2, and 2*c*3 measure the respective angles of the plurality of joints. Thus, it becomes possible to assess the approached state taking into consideration the posture of the front device 202*a*.

In addition, the work machine state measuring apparatuses 2*b*1, 2*b*2, 2*c*1, 2*c*3, and 2*d* measure the travelling velocity of the work machine 200, and the respective pivoting velocities of the plurality of joints that the front device 202*a* has. Thus, it becomes possible to assess the approached state taking into consideration the travelling velocity of the work machine 200 and the action velocity of the front device 202*a*.

In addition, the approached state definition 10*c* includes a state where the worker 100 approaches the work machine 200 in a movable state from a blind spot. Thus, it becomes possible to assess a worker 100 whose priority as the target of safety education is high.

Note that although the worker measuring apparatus 1, the management server 10, and the display apparatus 3 are explained as apparatuses independent from the work machines 200 in the present embodiment, these may be mounted on the work machine 200. Advantages similar to those of the present embodiment are achieved with the thus-configured work machine 200 also.

Second Embodiment

Figure 8:
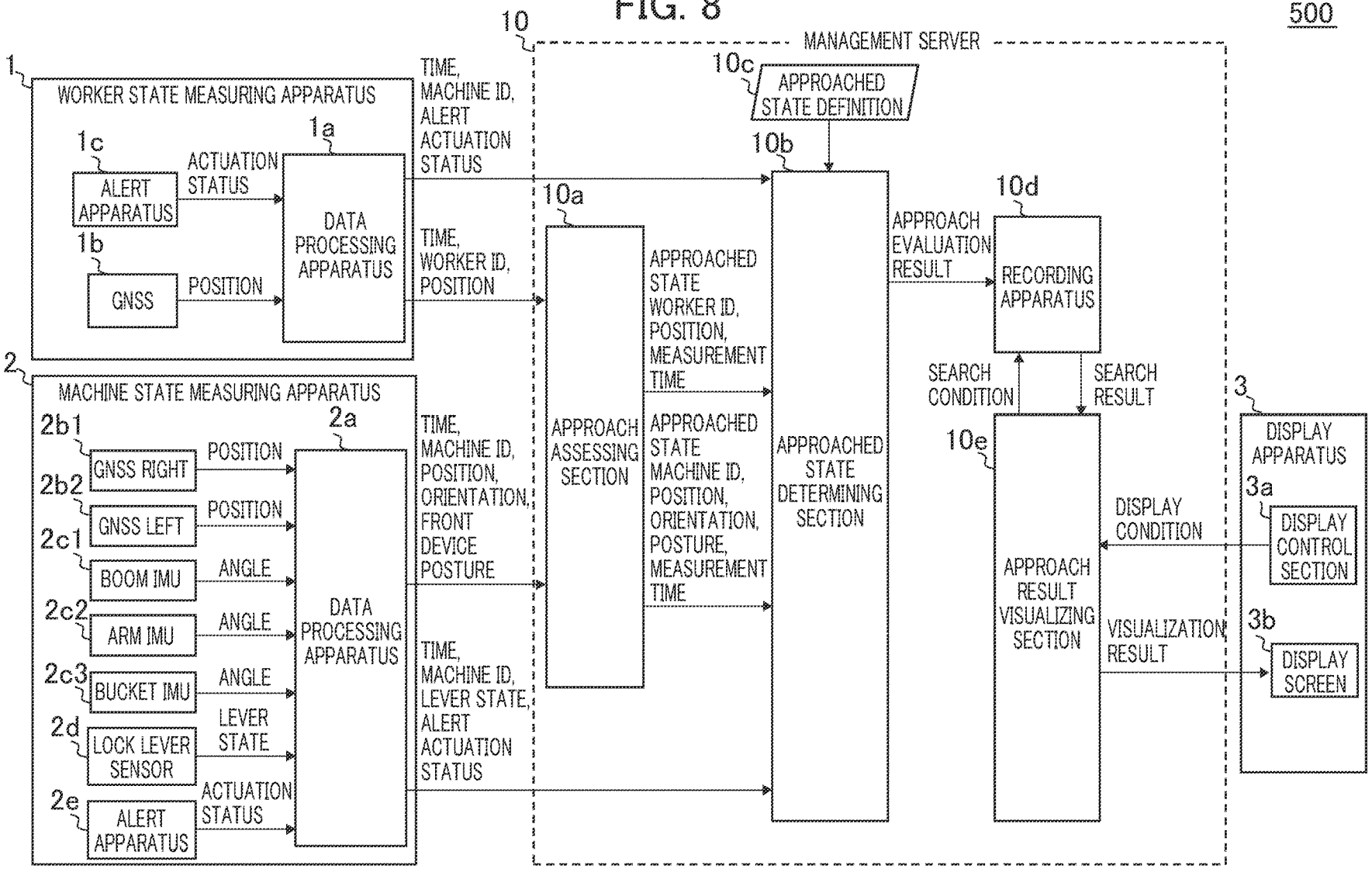
FIG. 8 is a functional block diagram depicting process functions of the work management system according to a second embodiment of the present invention.

FIG. 8 is a functional block diagram depicting process functions of the work management system 500 according to a second embodiment of the present invention. The worker measuring apparatus 1 includes, as an avoiding apparatus on a worker side, an alert apparatus 1*c* such as a buzzer that prompts to avoid contact with a work machine 200. The data processing apparatus 1*a* outputs, to the approached state determining section 10*b*, a time at which the alert apparatus 1*c* is actuated, the ID of a worker who owns the worker measuring apparatus 1, and an actuation status of the alert apparatus 1*c*. Here, the avoiding apparatus carried by the worker 100 is not limited to the alert apparatus 1*c*, but may include a radio or the like for communicating with an operator of a work machine 200.

The machine measuring apparatus 2 includes, as an avoiding apparatus on a machine side, an alert apparatus 2*e* such as a buzzer. The data processing apparatus 2*a* outputs, to the approached state determining section 10*b*, a time at which the alert apparatus 2*e* is actuated, the ID of a machine on which the machine measuring apparatus 2 is mounted, and an actuation status of the avoiding apparatus. Here, the avoiding apparatus mounted on the work machine 200 is not limited to the alert apparatus 2*e*, but may include a deceleration controller 7 (depicted in FIG. 14) like one that automatically decelerates and stops actions of the work machine 200, or the like.

FIG. 9 is a diagram depicting an example of the approached state definition 10*c* in the present embodiment. The approached state definition 10*c* takes into consideration a binary flag representing an actuation status of the avoiding apparatus on the worker side such as the alert apparatus 1*c* carried by the worker 100, and a binary flag representing an actuation status of the avoiding apparatus on the machine side such as the alert apparatus 2*e* mounted on the work machine 200. It is possible to interpret from the table of the approached state definition 10*c* that the likelihood of contact has been high when both the avoiding apparatus on the worker side and the avoiding apparatus on the machine side have not been in action.

(Summary)

The work management system 500 according to the present embodiment includes the avoiding apparatuses 1*c* and 2*e* that cause the work machine 200 and the worker 100 to avoid contact, and the management server 10 assesses the approached state of the work machine 200 and the worker 100 from the state of the work machine 200 measured at the time of the assessment of the approach between the work machine 200 and the worker 100, and the actuation statuses of the avoiding apparatuses 1*c*, 2*e*, and 7 at the time of the assessment of the approach, on the basis of the preset approached state definition 10*c*. In addition, the avoiding apparatuses 1*c*, 2*e*, and 7 in the present embodiment include the alert apparatuses 1*c* and 2*e* that issue alerts to an operator of the work machine 200 or the worker 100, or include the deceleration controller 7 that decelerates or stops the work machine 200.

According to the thus-configured present embodiment, by assessing the approached state taking into consideration the actuation statuses of the avoiding apparatuses 1*c*, 2*e*, and 7, it becomes possible for the manager to more accurately and detailedly grasp the likelihood of contact at the time of occurrence of approach.

Third Embodiment

Figure 10:
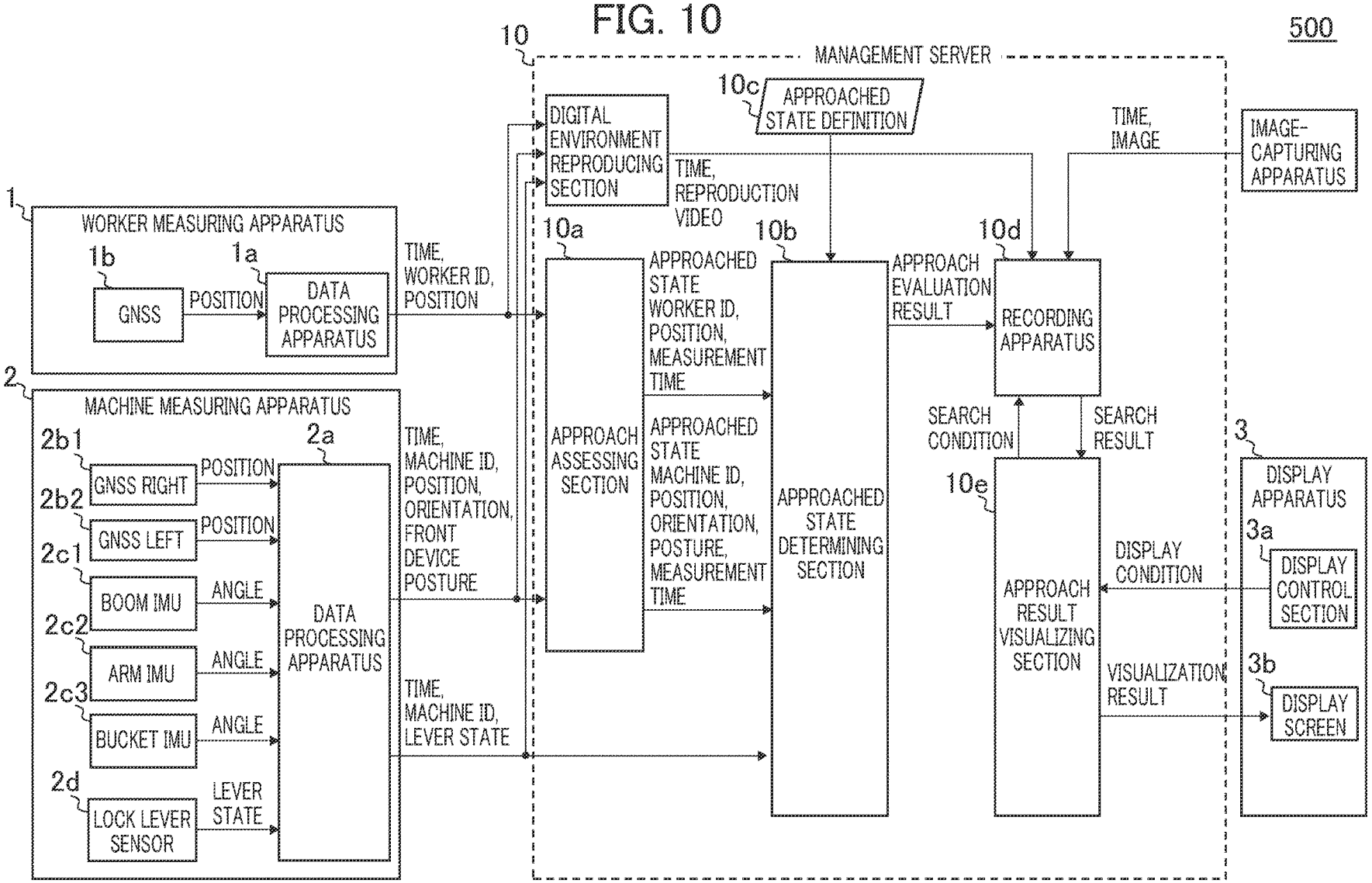
FIG. 10 is a functional block diagram depicting process functions of the work management system according to a third embodiment of the present invention.

FIG. 10 is a functional block diagram depicting process functions of the work management system 500 according to a third embodiment. The work management system 500 includes an image-capturing apparatus 6 such as a camera that captures images of the state of work performed by the worker 100 and the work machine 200. The image-capturing apparatus 6 outputs times at which the images have been captured and the captured images to the recording apparatus 10*d*. In the present embodiment, the image-capturing apparatus 6 is fixed to a pole, a building, or the like installed in the site, and is configured to be able to transmit information to the management server 10 via the network provided by the communication facility 4. Note that the installation method of the image-capturing apparatus 6 is not limited to the mode according to the present embodiment, but the image-capturing apparatus 6 may be installed at a helmet or the like worn by the worker 100 or on the exterior of the work machine 200. In addition, the number of image-capturing apparatuses 6 is not limited to one, but a plurality of image-capturing apparatuses 6 may be installed in the site, and the respective image-capturing apparatuses 6 may be connected to the network provided by the communication facility 4.

In addition, the management server 10 includes a digital environment reproducing section 10*f* that reproduces actions of the worker 100 and the work machine 200 measured with the worker measuring apparatus 1 and the machine measuring apparatus 2 by using Computer Graphics (CG) or the like in a digital environment. The digital environment reproducing section 10*f* outputs, to the recording apparatus 10*d* and in a format corresponding to times, a reproduction video visualizing the actions of the worker 100 and the work machine 200 that are reproduced in the digital environment.

Figure 11:
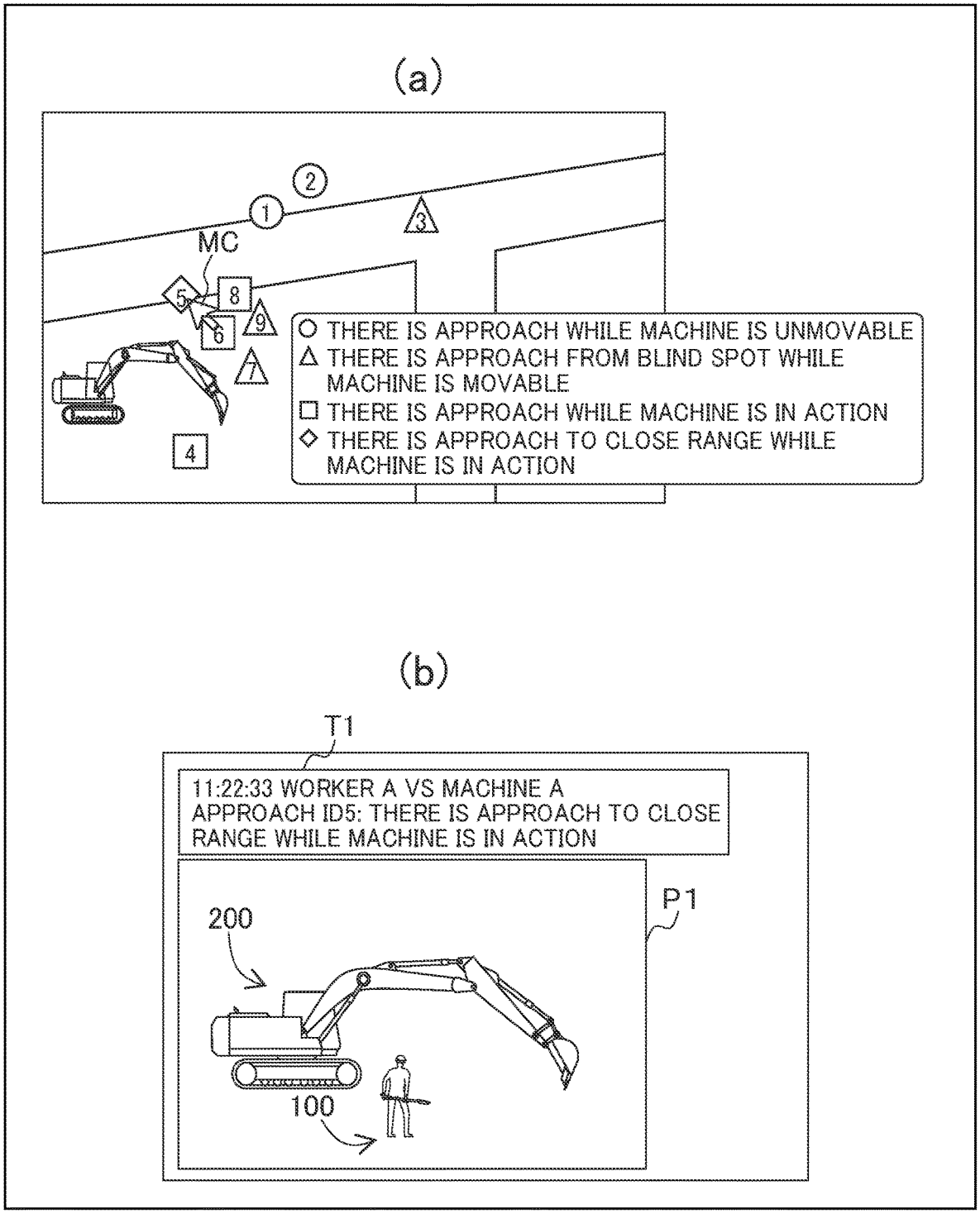
FIG. 11 is a diagram depicting examples of approach results outputted by the approach result visualizing section in the third embodiment of the present invention.

FIG. 11 is a diagram depicting examples of approach results outputted by the approach result visualizing section 10*e* in the present embodiment. FIG. 11A depicts an example of each approach occurrence portion labelled and plotted on a map, and selection of particular approach selected via the display control section 3*a* of the display apparatus 3. In the present embodiment, a user selects particular approach (ID: 5) via a mouse cursor MC. Since results in which approached states are labeled are provided to the user, it is possible for the user to efficiently select approach that is particularly likely to result in contact, and whose necessity for implementation of risk assessment is high.

FIG. 11B depicts an example of a method of displaying detail information about the selected approach. In the example depicted in FIG. 11B, the time of occurrence of the selected approach, the respective IDs of the worker 100 and the work machine 200 involved, and an approached state are displayed with a text T1. Furthermore, an image P1 captured with the image-capturing apparatus 6 at the time of occurrence of the selected approach is displayed. Note that images at the plurality of times before and after the time of occurrence of the approach may be displayed as one video. In addition, instead of the image P1 captured with the image-capturing apparatus 6, an image taken out from a reproduction video generated by the digital environment reproducing section 10*f* may be displayed. By checking such display results of detail information, the manager can grasp detailedly a situation at the time of occurrence of approach that is likely to result in contact, and can use the detail information for risk assessment or safety education.

(Summary)

The work management system 500 according to the present embodiment includes the image-capturing apparatus 6 that captures an image of the work machine 200 and the worker 100, and, when it is assessed that there is the approach between the work machine 200 and the worker 100, the management server 10 records, in association with the approached state, the image of the work machine 200 and the worker 100 captured with the image-capturing apparatus 6 at the time of the assessment of the approach, and outputs the image to the display apparatus 3.

Alternatively, when it is assessed that there is the approach between the work machine 200 and the worker 100, the management server 10 in the present embodiment creates a reproduction video visualizing actions of the work machine 200 and the worker 100 on the basis of the positional information about the work machine 200, the positional information about the worker 100, and the state of the work machine 200 measured at the time of the assessment of the approach, records the reproduction video in association with the approached state, and outputs the reproduction video to the display apparatus 3.

According to the thus-configured present embodiment, by displaying the image of the work machine 200 and the worker 100 along with the approached state, it becomes possible for the manager to grasp, efficiently and detailedly, a situation at the time of occurrence of the approach that is likely to result in contact.

Fourth Embodiment

Figure 12:
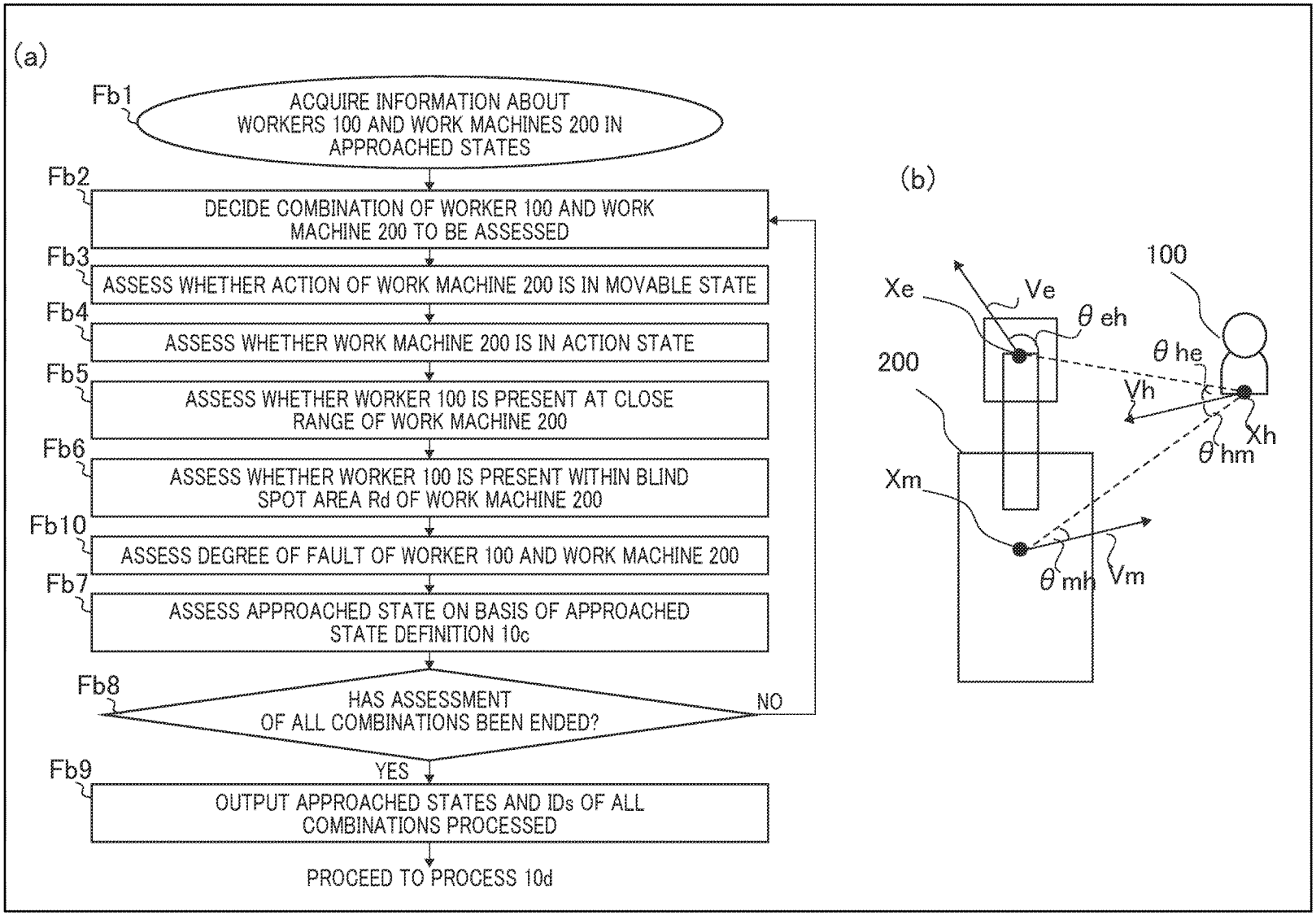
FIG. 12 is a figure depicting a processing procedure performed by the approached state determining section in a fourth embodiment of the present invention.

FIG. 12 is a figure depicting a processing procedure performed by the approached state determining section 10*b* according to a fourth embodiment. The processing procedure performed by the approached state determining section 10*b* depicted in FIG. 12A has a process Fb10 of assessing the degree of fault of the worker 100 and the degree of fault of the work machine 200 regarding approach that has occurred. The process Fb10 is implemented on the basis of three types of velocity information which are a velocity Vh determined by obtaining numerical differences of the position Xh acquired from the worker measuring apparatus 1 over time, the velocity Vm determined by obtaining numerical differences of the position Xm acquired from the machine measuring apparatus 2 over time, and the velocity Ve determined by obtaining numerical differences of the tip position Xe of the front device 202*a* computed on the basis of postural information acquired from the machine measuring apparatus 2 over time. Note that the determination of the degree of fault is not limited to a technique using velocity information, but the degree of fault may be decided according to the actuation status of the avoiding apparatus or approached state.

FIG. 12B depicts a definition of each state quantity used for the determination of the degree of fault. For the assessment of the degree of fault of the worker 100, angles θhm and θhe formed by the worker velocity Vh and two straight lines passing through the worker position Xh, and the machine position Xm and front device tip position Xe are used. A threshold Vth3 for the worker velocity Vh and thresholds θth1 and θth2 for the formed angles θhm and θhe are defined in advance. Where either $|Vh|>Vth3$ and $|\theta hm|<\theta th1$ or $|Vh|>Vth3$ and $|\theta he|<\theta th2$ is satisfied, there is a possibility that the worker 100 is approaching the work machine 200. Accordingly, it is determined that there is a fault of the worker 100 regarding an occurrence of approach.

For the assessment of the degree of fault of the work machine 200, angles θmh and θeh formed by the two straight lines passing through the machine position Xm and front device tip position Xe, and the worker position Xh, and the machine velocity Vm and front device tip position velocity Ve, respectively, are used. Thresholds Vth4 and Vth5 for the machine velocity Vm and the front device tip position velocity Ve, and thresholds θth3 and θth4 for the angles θmh and θeh are defined in advance. Where either $|Vm|>Vth4$ and $|\theta mh|<\theta th3$ or $|Ve|<Vth4$ and $|\theta eh|>\theta th4$ is satisfied, there is a possibility that the work machine 200 is approaching the worker 100. Accordingly, it is determined that there is a fault of the work machine 200 regarding an occurrence of approach. Note that although, in the present embodiment, the degree of fault is determined in a dichotomous manner in such a way as to determine whether or not there is a fault, it may be determined in a consecutive manner according to the velocity or the magnitude of formed angle.

Figure 13:
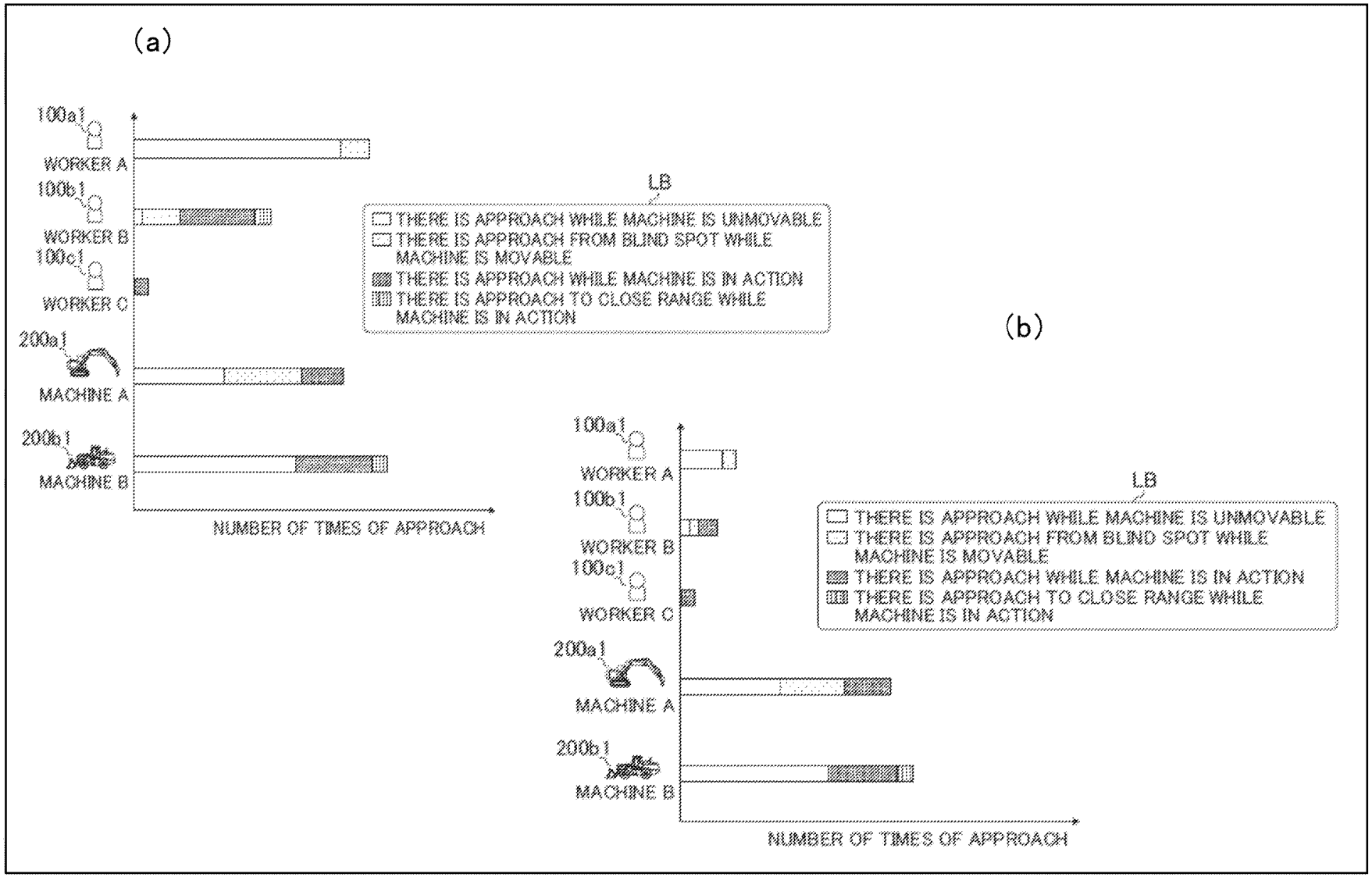
FIG. 13 is a figure depicting examples of an expression method of degree of fault and advantages of the present invention according to the fourth embodiment of the present invention.

FIG. 13 is a figure depicting examples of an expression method of the degree of fault and advantages of the present invention in the fourth embodiment. FIG. 13A depicts an example in which the number of times of approach is displayed on a bar chart not reflecting the degree of fault. In the chart depicted in FIG. 13A, when approach has occurred, the number of times of approach of a worker 100 and the number of times of approach of a work machine 200 involved in the approach are incremented. Accordingly, a worker 100 or a work machine 200 that is involved in approach without fault is undesirably evaluated so as to have a larger number of times of approach despite the less fault.

FIG. 13B depicts an example in which the number of times of approach is displayed on a bar chart reflecting the degree of fault. In the chart in FIG. 13B, when approach has occurred, the number of times of approach of only a worker 100 or a work machine 200 that is determined as being involved in approach with fault is incremented. Accordingly, a worker 100 or a work machine 200 that is involved in approach without fault is evaluated as having a small number of times of approach. The example in FIG. 13B depicts a result in a case where the number of occurrences of approach with fault is small on the worker 100 side, and the number of occurrences of approach with fault is great on the side of the work machine 200. Since the result of degree of fault is reflected, such a result that the number of times of approach of the worker 100 is relatively small, and the number of times of approach of the work machine 200 is relatively great is displayed. As a result, the manager can determine to raise the priority, regarding safety education, of an operator of the work machine 200 who has high degree of fault.

(Summary)

The management server 10 in the present embodiment, when assessing that there is approach between the work machine 200 and the worker 100, calculates the degree of fault of an operator of the work machine 200 and the degree of fault of the worker 100 regarding an occurrence of the approach on the basis of the measurement information of the work machine position measuring apparatuses 2*b*1 and 2*b*2, the worker position measuring apparatus 1*b*, and the work machine state measuring apparatuses 2*c*1, 2*c*2, 2*c*3, and 2*d* at the time of the assessment of the approach, records the degree of fault in association with the approached state of the work machine 200 and the worker 100, and outputs the degree of fault to the display apparatus 3.

According to the thus-configured present embodiment, it becomes possible for the manager to efficiently and accurately grasp a worker 100 or an operator of a work machine 200 whose priority of education is high, by displaying the degree of fault of the operator of the work machines 200 and the degree of fault of the worker 100 regarding occurrence of approach in association with approached state.

Fifth Embodiment

Figure 14:
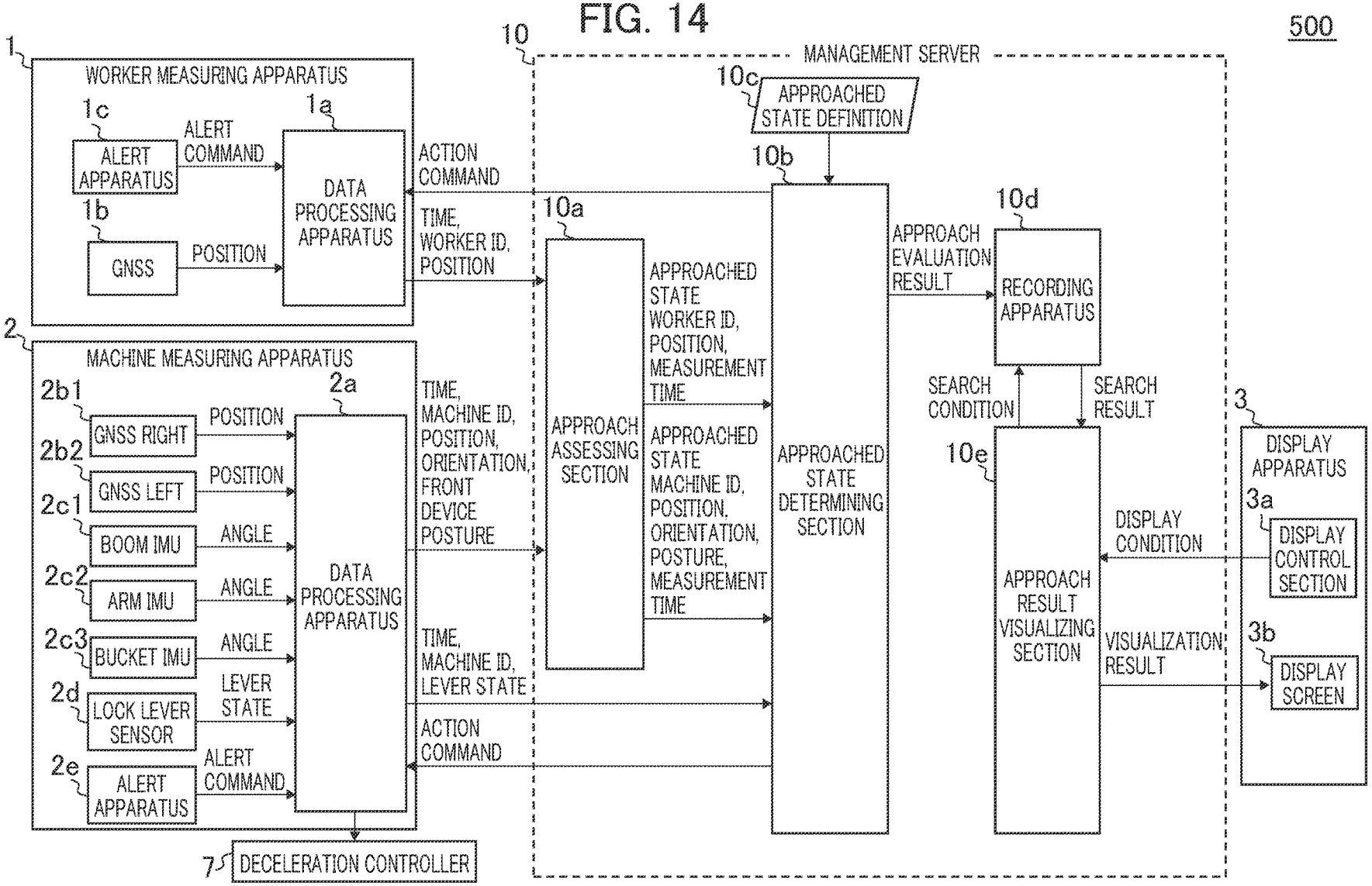
FIG. 14 is a functional block diagram depicting process functions of the work management system according to a fifth embodiment of the present invention.

FIG. 14 is a functional block diagram depicting process functions of the work management system 500 according to a fifth embodiment of the present invention. The work management system 500 according to the present embodiment includes the alert apparatus 1*c* carried by the worker 100 and the alert apparatus 2*e* mounted on the work machine 200, similarly to the second embodiment. Furthermore, the work management system 500 according to the present embodiment includes the deceleration controller 7 that automatically decelerates or stops actions of the work machine 200. The alert apparatuses 1*c* and 2*e* and the deceleration controller 7 are configured to be able to receive action commands from the management server 10 via the network provided by the communication facility 4. In a case where the work machine 200 is the hydraulic excavator 200*a*, valves and the like that interrupt or restrict a hydraulic fluid supplied to hydraulic actuators such as hydraulic cylinders or a hydraulic motor are included in the deceleration controller 7. In a case where the work machine is the wheel loader 200*b*, a brake and the like are included in the deceleration controller 7, in addition to the valves mentioned before.

FIG. 15 is a diagram depicting an example of measures to be taken regarding the approached states 10*c* in the present embodiment. By defining a correspondence table TA of approached states and measures like those depicted in FIG. 15 in advance, a user can optionally set measures to be taken depending on the approached states as desired. In the present embodiment, three ways which are alerts by the alert apparatuses 1*c* and 2*e*, deceleration control of the work machine 200 by the deceleration controller 7 of the work machine 200, and stop control of the work machine 200 by the deceleration controller 7 of the work machine 200 are prepared. This is useful for operational use of a system in which measures with higher effect of direct-contact avoidance are taken as alert levels increase.

(Summary)

The work management system 500 in the present embodiment includes the avoiding apparatuses 1*c*, 2*e*, and 7 that cause the work machine 200 and the worker 100 to avoid contact, and the management server 10 outputs, to the avoiding apparatuses 1*c*, 2*e*, and 7, commands according to the approached state of the work machine 200 and the worker 100.

According to the thus-configured present embodiment, it becomes possible to appropriately correct inappropriate behavior of the worker 100 or an operator of the work machine 200 in the site by actuating the avoiding apparatuses 1*c*, 2*e*, and 7 without excess or inadequacy according to approached states of the work machine 200 and the worker 100.

Although embodiments of the present invention have been described in detail thus far, the present invention is not limited to the embodiments described above, but includes various modification examples. For example, the embodiments described above are explained in detail for explaining the present invention in an easy-to-understand manner, and are not necessarily limited to those including all the constituent elements explained. In addition, it is also possible to add some of the constituent elements of an embodiment to the constituent elements of another embodiment, and it is also possible to remove some of the constituent elements of an embodiment or to replace some of the constituent elements of an embodiment with some of the constituent elements of another embodiment.

DESCRIPTION OF REFERENCE CHARACTERS

1: Worker measuring apparatus
1*a*: Data processing apparatus
1*b*: GNSS (worker position measuring apparatus)
1*c*: Alert apparatus (avoiding apparatus)
2: Machine measuring apparatus
2*a*: Data processing apparatus
2*b*1: GNSS right (work machine position measuring apparatus)
2*b*2: GNSS left (work machine position measuring apparatus)
2*c*1: Boom IMU (work machine state measuring apparatus)
2*c*2: Arm IMU (work machine state measuring apparatus)
2*c*3: Bucket IMU (work machine state measuring apparatus)
2*d*: Sensor (work machine state measuring apparatus)
2*e*: Alert apparatus (avoiding apparatus)
3: Display apparatus
3*a*: Display control section
3*b*: Display screen
5: Communication terminal
6: Image-capturing apparatus
7: Deceleration controller (avoiding apparatus)
10: Management server
10*a*: Approach assessing section
10*b*: Approached state determining section
10*c*: Approached state definition
10*d*: Recording apparatus
10*e*: Approach result visualizing section
10*f*: Digital environment reproducing section
100, 100*a*, 100*b*: Worker
100*a*1: Worker A
100*b*1: Worker B
200: Work machine
200*a*: Hydraulic excavator
200*b*: Wheel loader
201*a*: Upper swing structure
202*a*: Front device
300: Office
500: Work management system

The invention claimed is:

1. A work management system comprising:

a management server;

a display apparatus that displays information outputted from the management server; and a work machine configured to receive action commands from the management server, wherein the management server is configured to:

store an approached state definition in which approached states are defined from a combination including a movable state, an action state, a distance state, and a blind spot state in advance, and information on the action commands according to the approached states, the movable state being whether or not an operation of the work machine is limited, the action state being whether or not the work machine is acting, the distance state being a state regarding a distance between the work machine and a worker who performs work near the work machine, the blind spot state being whether or not the worker is present within a blind spot area of the work machine; and execute steps of:

computing the movable state, the action state, the distance state, and the blind spot state based on measurement information of a work machine state measuring apparatus that measures a state of the work machine including a posture of a front device of the work machine;

assessing whether or not there is approach between the work machine and the worker, on a basis of positional information about the work machine measured by a work machine position measuring apparatus that measures the positional information about the work machine, and positional information about the worker measured by a worker position measuring apparatus that measures the positional information about the worker;

when assessing that there is approach, assessing an approached state of the approach from the computed movable state, action state, distance state, and blind spot state, on a basis of the approached state definition;

recording the state of the work machine measured at a time when it is assessed that there is the approach, in association with the approached state of the approach, and outputting the state of the work machine to the display apparatus in association with the approached state of the approach; and outputting, to the work machine, an action command according to the approached state of the approach, and the work machine automatically decelerates and stops an action of the work machine according to the action command received from the management server.

2. The work management system according to claim 1, wherein the work management system includes an image-capturing apparatus that captures an image of the work machine and the worker, and the management server is configured to, when assessing that there is the approach, record an image of the work machine and the worker captured with the image-capturing apparatus at the time when it is assessed that there is the approach, in association with the approached state, and output the image to the display apparatus.

3. The work management system according to claim 1, wherein the management server is configured to, when assessing that there is the approach, create a reproduction video that visualizes actions of the work machine and the worker on a basis of the positional information about the work machine, the positional information about the worker, and the state of the work machine that are measured at the time when it is assessed that there is the approach, record the reproduction video in association with the approached state, and output the reproduction video to the display apparatus.

4. The work management system according to claim 1, wherein the management server is configured to, when assessing that there is the approach, calculate a degree of fault of an operator of the work machine and a degree of fault of the worker regarding an occurrence of the approach on a basis of measurement information of the work machine position measuring apparatus, the worker position measuring apparatus, and the work machine state measuring apparatus at the time when it is assessed that there is the approach, record the degrees of fault in association with the approached state, and output the degrees of fault to the display apparatus.

* * * * *